US005137060A

United States Patent [19]

Wolcott

[11] Patent Number: 5,137,060

[45] Date of Patent: Aug. 11, 1992

[54] MANUAL BAND INSTALLATION TOOL

[75] Inventor: Wayne B. Wolcott, Englewood, Ohio

[73] Assignee: Joslyn Corporation, Chicago, Ill.

[21] Appl. No.: 652,864

[22] Filed: Feb. 8, 1991

Related U.S. Application Data

[63] Continuation of Ser. No. 370,597, Jun. 23, 1989, Pat. No. 5,000,232.

[51] Int. Cl.[5] ..... B21F 9/02

[52] U.S. Cl. ..... 140/23.6; 140/150

[58] Field of Search ..... 140/93.1, 93.4, 123.6, 140/150, 152

[56] References Cited

U.S. PATENT DOCUMENTS

| | | | |
|---|---|---|---|
| 4,548,242 | 10/1985 | Paradis | 140/123.6 |
| 4,726,403 | 2/1988 | Young et al. | 140/123.6 |
| 4,793,385 | 12/1988 | Dyer et al. | 140/123.6 |
| 4,928,738 | 5/1990 | Marelin et al. | 140/123.6 |

*Primary Examiner*—Lowell A. Larson

*Attorney, Agent, or Firm*—Mason, Kolehmainen, Rathburn & Wyss

[57] ABSTRACT

A manual banding tool is provided with a band tension limit, which can be adjusted while the tool is coupled to a test device, such as a strain gauge. The manual banding tool includes a shuttle mechanism for incrementally advancing the band through the tool during a forward stroke. The shuttle mechanism is mechanically coupled to a pivotally mounted handle by way of an overcenter toggle mechanism. The overcenter toggle mechanism is coupled to a spring tensioning assembly, which includes a plurality of spring members, such as Belleville washers, disposed near the rear of the tool. An adjustment screw on the rear cover portion of the tool allows the spring tension of the spring members to be adjusted. Once the band tension limit is reached, the spring members collapse, allowing the overcenter toggle mechanism to lock the handle in position thereby preventing further movement of the shuttle mechanism. The termination may then be bent by hand such that the band is at approximately a 90° angle with respect to the buckle to maintain the tension in the band. A handle operated shear is then operated to allow the termination to be removed from the tool. The outwardly extending tail portion of the band is subsequently placed adjacent the rollover assembly to allow the tail portion to be fully bent over the buckle.

4 Claims, 8 Drawing Sheets

MANUAL BAND INSTALLATION TOOL

This is a continuing application of application Ser. No. 07/370,597, filed June 23, 1989 now U.S. Pat. No. 5,000,232 granted Mar. 19, 1991.

CROSS REFERENCE TO RELATED APPLICATION

This application is related to copending application Ser. No. 277,325, filed on Nov. 29, 1988, now Pat. No. 4,934,416 granted June 19, 1990.

1. Field of the Invention

The present invention relates to a manual banding tool for tightening and securing a band about a termination sleeve at a predetermined band pressure which may be relatively easily adjusted.

2. Background of the Invention

Banding tools are known and used in a wide variety of applications. One application of such a banding tool is to tighten and secure a band about a woven metal braid portion of an electrical cable about a tubular termination sleeve portion of an electrical connector. In such an application, it is important that the band tension be sufficient to provide a good electrical connection between the woven metal braid and the termination sleeve. On the other hand, if the band tension is too high, the termination sleeve can be damaged or even cracked. In some known banding tools, the proper termination tension of the band is subjectively determined by the operator. However, with such tools, it is virtually impossible to provide terminations having a relatively constant band tension. Also, it is possible for a relatively unexperienced operator to crack or damage the termination sleeve, often made from cast aluminum.

Other known manual banding tools are provided with means for tightening a band about a termination sleeve within a predetermined band tension limit. Examples of such manual banding tools are disclosed in U.S. Pat. Nos. 4,688,607 and 4,726,403. In these tools, once the band is inserted into the tool the band, it is received by a reciprocally mounted first gripper device which maintains the tension on the band during the return stroke of a second gripper device. The second gripper device incrementally advances the band through the tool during a rearward stroke. A pair of link members are mechanically coupled to the second gripper device and advance the second gripper device back and forth to tighten the band about a termination sleeve. The link members are also coupled to a tension actuator device, which disables the advancing mechanism when the band tension is at a predetermined level. The tension actuator device utilizes a spring member, such as a Belleville spring washer, to determine the tension limit at which the spring compresses allowing the link mechanism to be drawn over center holding the set tension limit.

Even though the components of such a tool are machined to a relatively close tolerance, it is necessary to test the actual band tension limit of the tool before shipment. If the band tension limit is determined by the test to be greater than the tension limit for which the tool was designed, the tension limit must be adjusted at the factory before the tool is shipped.

In some known banding tools the band tension limit is fixed. In other known banding tools, such as illustrated in U.S. Pat. Nos. 4,688,607 and 4,726,403, the band tension limit is adjusted by adjusting the length of the stroke of the first gripper device. This is done by providing an adjustment screw, accessible from the front portion of the tool, which acts as a stop for the first gripper device to shorten its stroke. However, this is a relatively crude adjustment Moreover, such an adjustment does not actually adjust the band tension limit. Thus, the band tension limit cannot be adjusted while the tool is coupled to a test device, such as a strain gauge. With such tools, the proper adjustment is attained by trial and error. More specifically, it is necessary to uncouple the tool from the test device, adjust the stroke by way of the adjustment screw, recouple the test device and measure the band tension limit again. If the band tension limit is still too high, the process is repeated. Such an adjustment process is relatively cumbersome and time-consuming.

Additionally, in the known banding tools, disclosed in U.S. Pat. Nos. 4,688,607 and 4,726,403, a separate tool is required to complete the termination. More specifically, before the band is severed from the tool, the band is bent over the buckle at about a 90° angle to secure the tension in the band. Subsequently the band is cut leaving a tail portion extending outwardly from the buckle. A separate tool is known to be used to bend the tail portion completely over the buckle. However, this requires the use of two tools, which results in more time to complete the termination thus increasing the labor cost. Also, since two tools are required, the tool cost is relatively more expensive.

SUMMARY OF THE INVENTION

It is an object of the present invention to provide a manual banding tool having a predetermined band tension limit.

It is another object of the present invention to provide a banding tool with a predetermined band tension limit, which can be adjusted while the tool is coupled to a calibration device.

It is yet a further object of the present invention to provide a single tool for tightening a band around a termination sleeve, cutting the band, and bending the extending tail portion over the buckle.

Briefly, the present invention relates to a manual banding tool, wherein the band tension limit can be adjusted while the tool is coupled to a calibration device. The manual banding tool in accordance with the present invention includes a shuttle assembly for incrementally advancing the band through the tool during a forward stroke. The shuttle assembly is mechanically coupled to a pivotally mounted handle by way of a overcenter toggle mechanism. The overcenter toggle mechanism is connected to a spring tensioning assembly, which includes a plurality of spring members, such as Belleville washers, disposed near the rear of the tool. An adjustment screw disposed adjacent the rear portion of the tool allows the spring tension of the spring tensioning assembly to be adjusted. Accordingly, the band tension limit can be set while the tool is coupled to a calibration device. A gripper device, consisting of a pawl with one or more teeth is mounted adjacent a front nosepiece of the band to hold the tension in the band during return strokes of the shuttle assembly. Once the band tension limit is reached, the spring members collapse allowing the toggle assembly to be pulled overcenter thereby preventing further movement of the shuttle assembly. The termination is bent by hand such that the band portion extending outwardly from the buckle is at approximately a 90° angle with respect to the buckle to maintain the tension in the band. A handle operated shear severs the band to allow the termination to be removed from the tool. A slot is provided on the tool to prebend the end of the band forming a tab to create a burr free termination. The tab is then received in a rollover assembly that bends the end of the band over the buckle causing the prebent tab to point downwardly toward the band surface hiding sharp edges. Thus, the manual banding tool, in accordance with the present invention, allows a single tool to be used for a complete termination.

BRIEF DESCRIPTION OF THE DRAWING

These and other objects of the present invention will be readily understood with reference to the following drawing and the accompanying text where.

DETAILED DESCRIPTION

Figure 1:
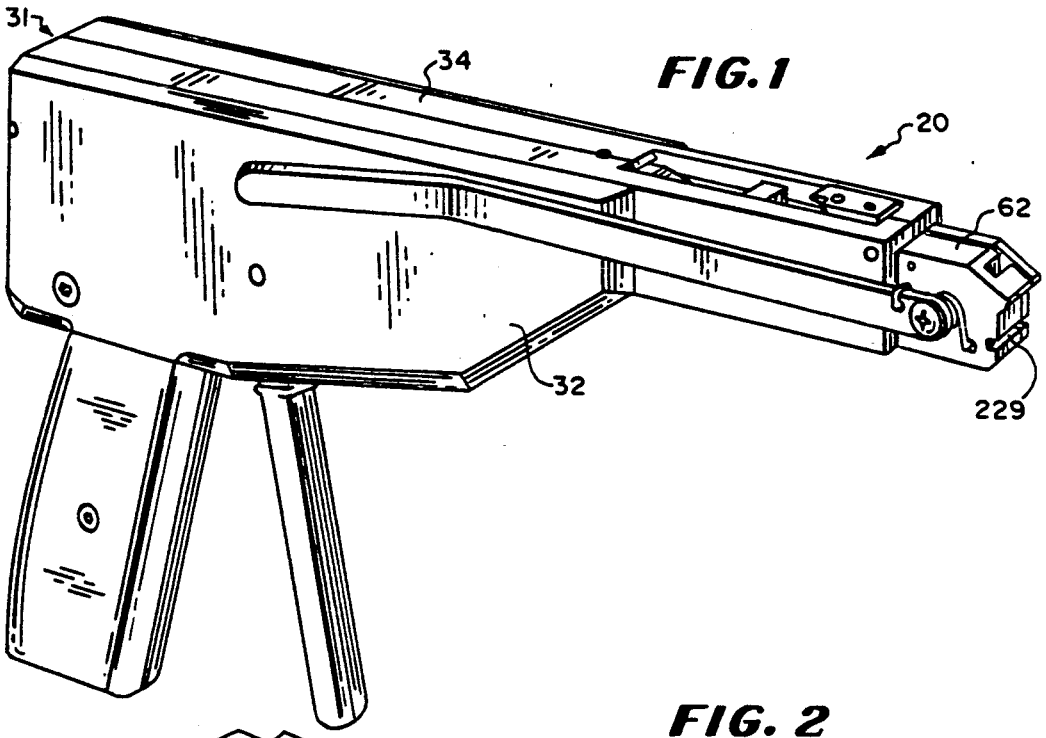
FIG. 1 is a perspective view of the manual banding tool in accordance with the present invention.
Figure 2:
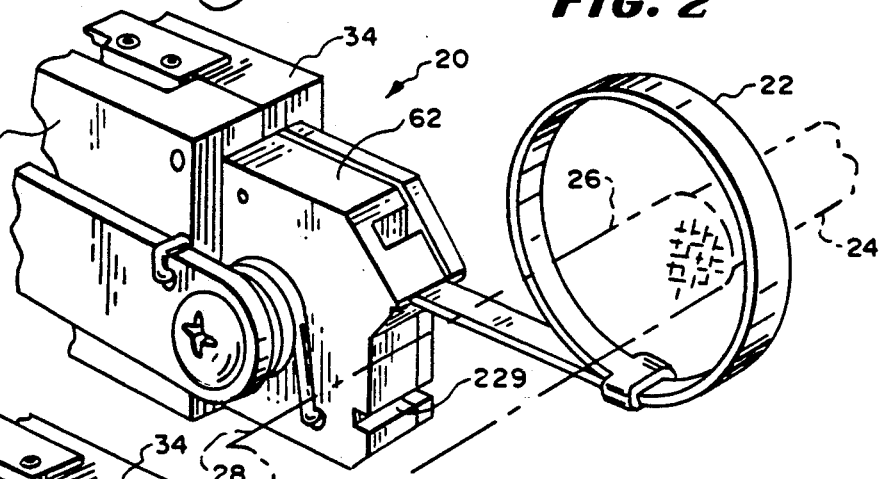
FIG. 2 is a perspective view of the front portion of the banding tool of FIG. 1, illustrating a band before being tightened about a termination sleeve of an electrical connector.
Figure 3:
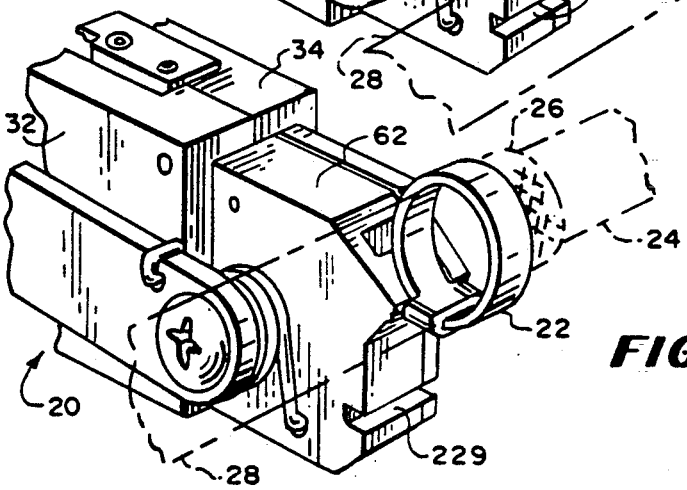
FIG. 3 is similar to FIG. 2 and illustrates the band tightened about a termination sleeve of an electrical connector.

The tool in accordance with the present invention, generally identified by the reference numeral 20, allows a metal band 22 to be tightened about a tubular sleeve 24, such as a termination sleeve, formed as part of an electrical connector (not shown) or a termination sleeve on an electrical connector accessory, such as a back shell (not shown). The band 22 is often used to tightly secure a woven metal braid 26, used as an electromagnetic shield for an electrical cable 28, to a termination sleeve. In such an application, it is important that there be a good electrical connection between the woven metal braid 26 and the termination sleeve 24. However, it is also important that the band tension limit be such that the termination sleeve 24 is not damaged or cracked during the tightening operation. The manual banding tool 20, in accordance with the present invention, is provided with a spring tensioning assembly 30, which controls the band tension limit within a predetermined range. An important aspect of the invention relates to the means by which the band tension limit can be adjusted while the tool is coupled to a test device, such as a strain gauge (not shown) for measuring the band tension limit.

Figure 4:
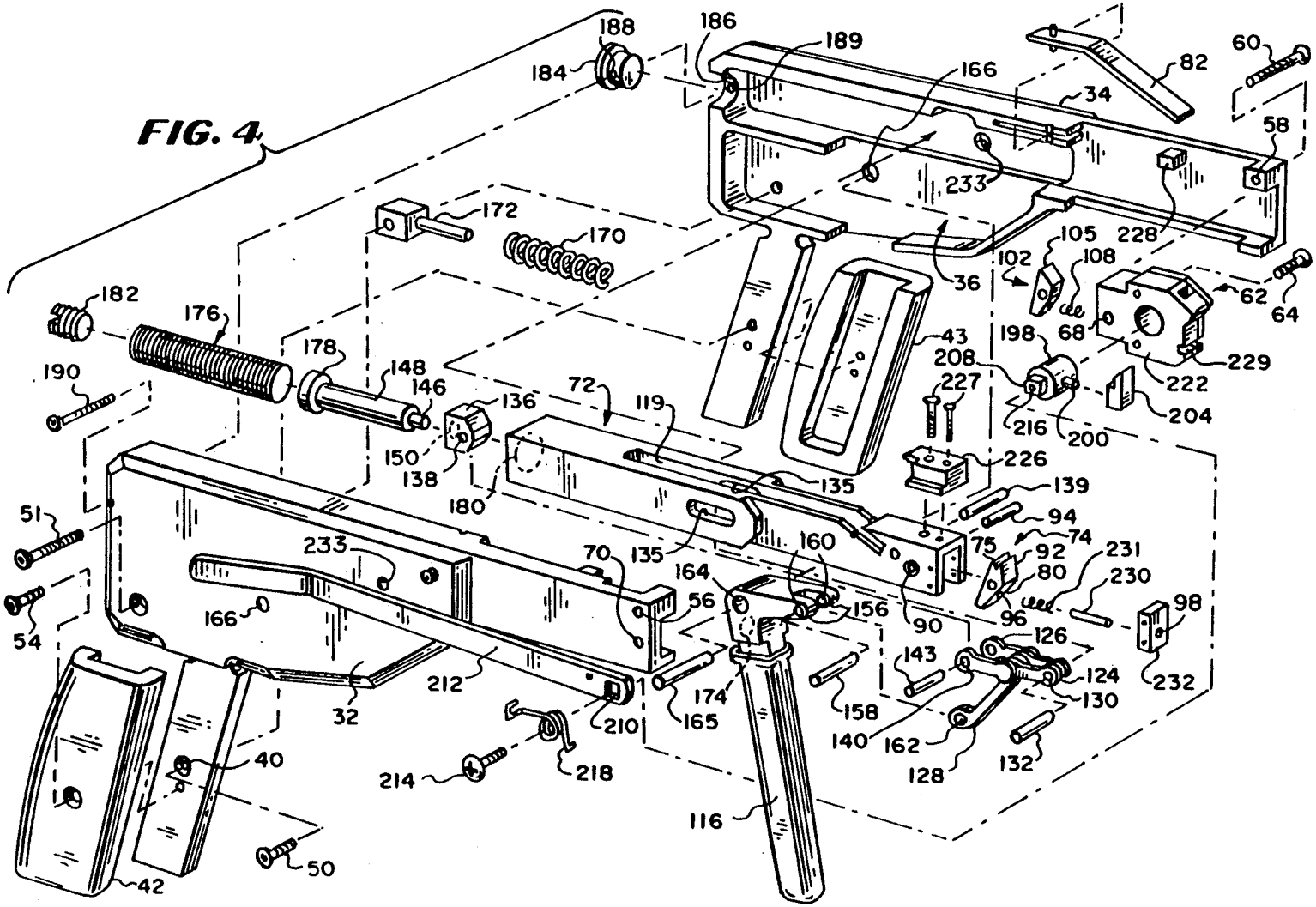
FIG. 4 is an exploded perspective view of the manual banding tool in accordance with the present invention.

The tool 20 includes a housing 31, formed from right body half 32 and coextensive left body half 34, defining internal cavities 36 (FIG. 4) for housing the internal components of the tool 20. When the right body half 32 and the left body half 34 are assembled, an aperture in the rear portion of the right body half 32 is aligned with a threaded aperture in the left body half 34 to allow the rear portion of the tool housing 31 to be secured together with a fastener 51. A fastener 50 is received in aligned apertures in the handle portion of the housing 31 to secure the handle portion of the tool housing 31 together.

A handle grip assembly, formed from a right handle portion 42 and a left handle portion 43 is secured to the handle portion of the housing 31 with a pair of fasteners 54 received in threaded apertures 40 on each side of the handle portion of the housing 31. The handle grip assembly 42 is formed from molded plastic adapted to fit over the handle portions and abut against the underside of the housing 31.

An aperture 56 is provided in the right body half 32 in the front portion of the tool 31. The aperture 56 is aligned with a threaded aperture 58 in the left body half 34 to allow a fastener 60 to be inserted therethrough to secure the front portion of the right body half 32 and the left body half 34 together.

A nosepiece assembly 62 is attached to the front portion of the tool. More specifically, a fastener 64 is inserted through an aperture 68 in the nosepiece assembly 62 and into a threaded aperture 70 in the right body half 32 to secure the nosepiece assembly 62 to the front portion of the tool 31.

A shuttle assembly 72, reciprocally mounted within the tool 31, is utilized to incrementally advance the band 22 through the tool. The shuttle assembly 72 includes a tensioning pawl assembly 74 having one or more teeth 75, disposed on one end for gripping the band 22. The shuttle assembly 72 also includes a shuttle 76, which carries a tensioning pawl 80.

The tensioning pawl 80 is pivotally connected to the shuttle 76. More specifically, a pair of apertures 90 are provided in the shuttle 76. These apertures 90 are aligned with an aperture 92 in the tensioning pawl 80. A pin 94 is inserted through the apertures 90 and 92 to provide a pivotal mounting of the tensioning pawl 80 with respect to the shuttle 76.

Figure 7:
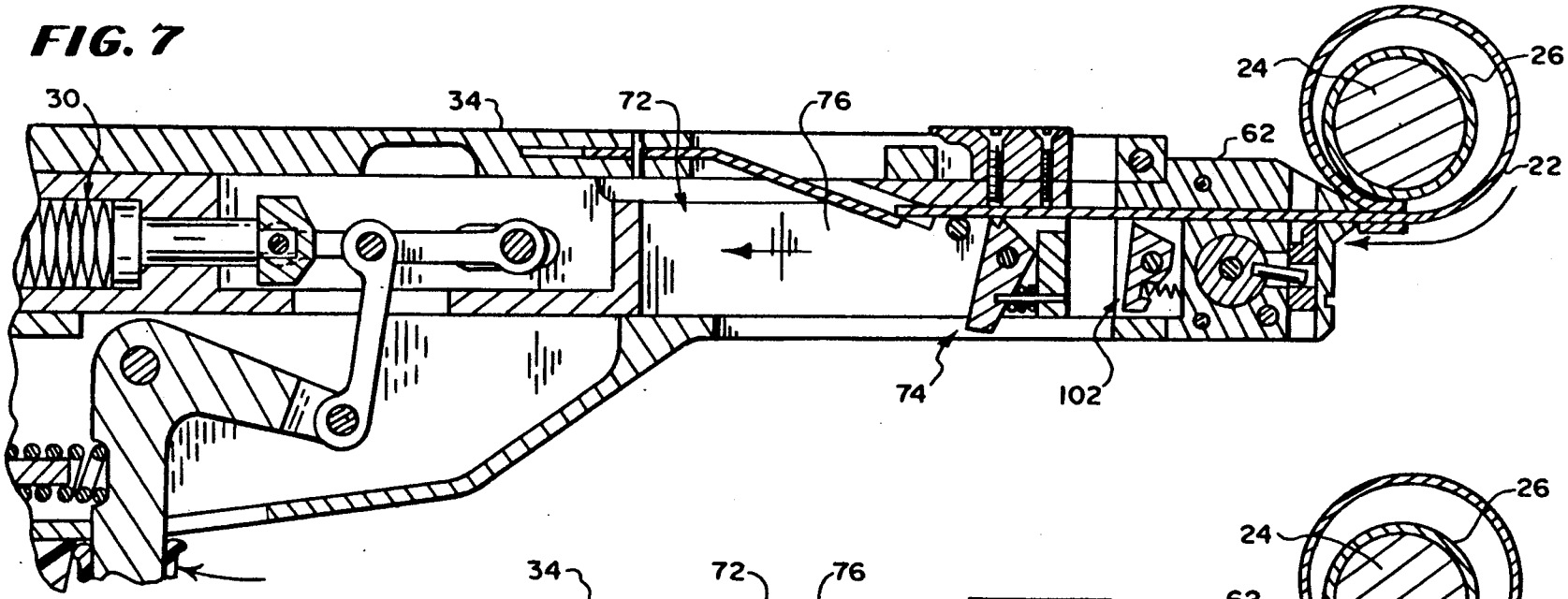
FIG. 7 is an enlarged partial sectional view of the front portion of the manual banding tool illustrated in FIG. 1, showing the position of the components during a forward stroke of the shuttle mechanism.
Figure 8:
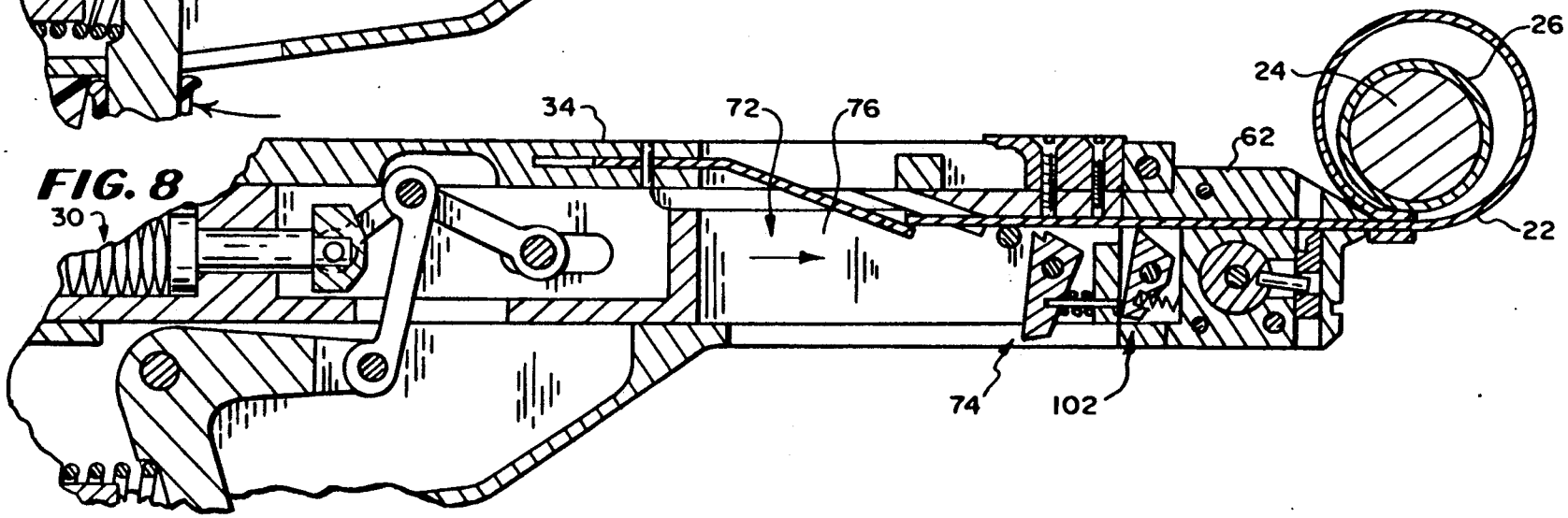
FIG. 8, similar to FIG. 7, illustrates the position of the components during a return stroke of the shuttle mechanism.
Figure 9:
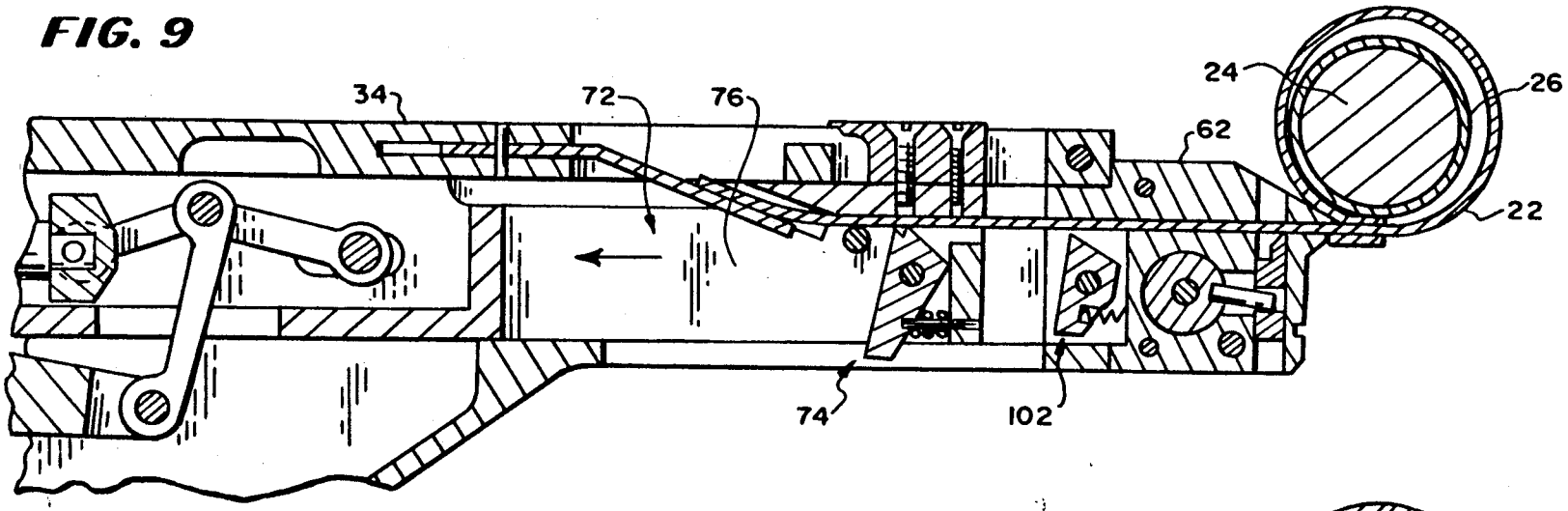
FIG. 9, similar to FIG. 7, illustrates the position of the components during a subsequent forward stroke of the shuttle mechanism.
Figure 10:
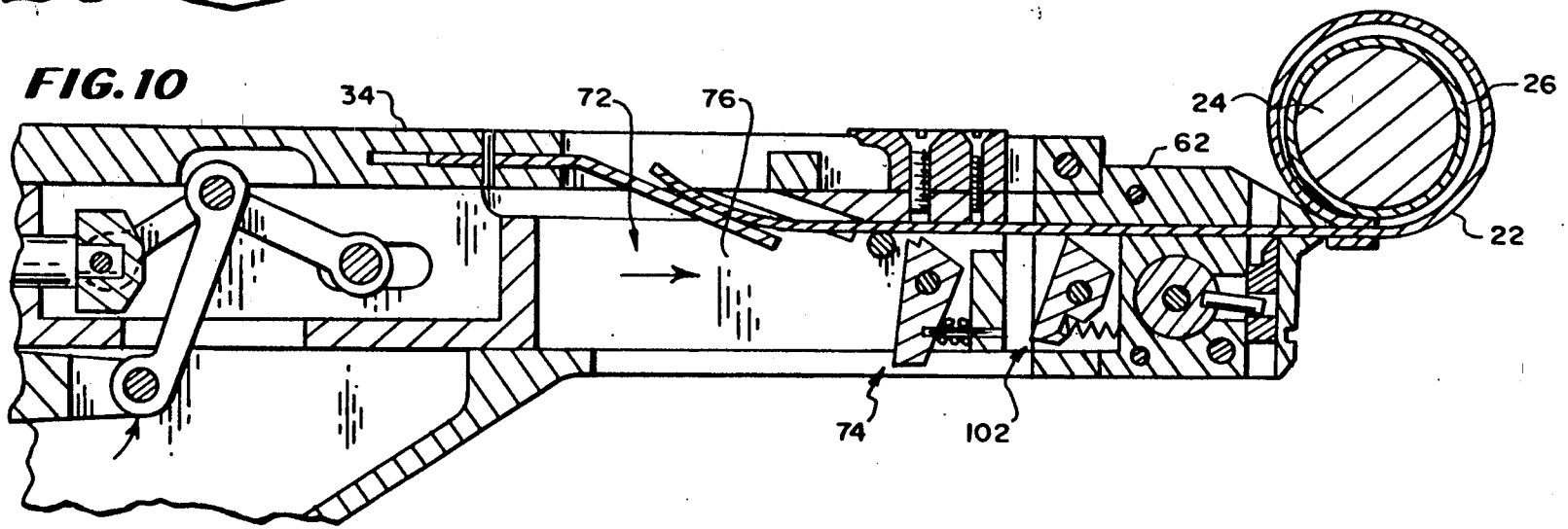
FIG. 10, similar to FIG. 8, illustrates the position of the components in the tool during a subsequent return stroke of the shuttle mechanism.

The tensioning pawl 80 is provided with a bore 96 for receiving one end of a pin 230. A spring 231 is disposed about the pin 230 and into another bore 98, provided in a block 232, secured to the front portion of the shuttle 76. The pin 230 allows a retaining paul 102 to release the band 22 any time it has been improperly inserted. More specifically, when a band 22 has been inserted into the tool incorrectly, for example, upside down, the band 22 can be removed from the tool 31 by pulling the band 22 out of the tool 20. The band 22 can be manually released by rotating the bottom end of the tensioning pawl 80 in a counterclockwise direction (FIG. 5) which will, in turn, cause the pin 230 to engage the retaining pawl 104 causing it to rotate counterclockwise (FIG. 5) thereby releasing the mechanisms from gripping the band 22. The spring 231 biases the tensioning pawl 80 such that teeth 75 grip the undersurface of the band 22 to allow the band 22 to be pulled through the tool 31 as shown in FIG. 7. On the return stroke of the shuttle assembly 72, the tensioning pawl 80 releases the band 22, as shown in FIG. 8.

During the return stroke of the shuttle assembly 72, the tension in the band 22 is held by a retaining pawl assembly 102. The retaining pawl assembly 102 includes the retaining pawl 104, having one or more teeth 105, pivotally mounted to the rear portion of the nosepiece assembly 62 by a pin 107. The bottom portion of the retaining pawl 102 is provided with a bore 106 for receiving one end of a other end of the spring 108. The other end of the spring 108 seats against the nosepiece assembly 62. The spring 108 biases the retaining pawl 102 in a clockwise direction (FIG. 5).

The nosepiece assembly 62 includes a slot 110, which forms a portion of the feed path for the band 22. A pin 139 supported by the housing halves 32 and 34 is disposed along the feedtrack just beyond tensioning pawl 80 to support the band 22. Once the leading edge of the band 22 advances past the support pin 139, the band is guided by a ramp 82 which guides the band 22 toward the band exit opening on the top portion of the tool 20.

Figures 5, 6:
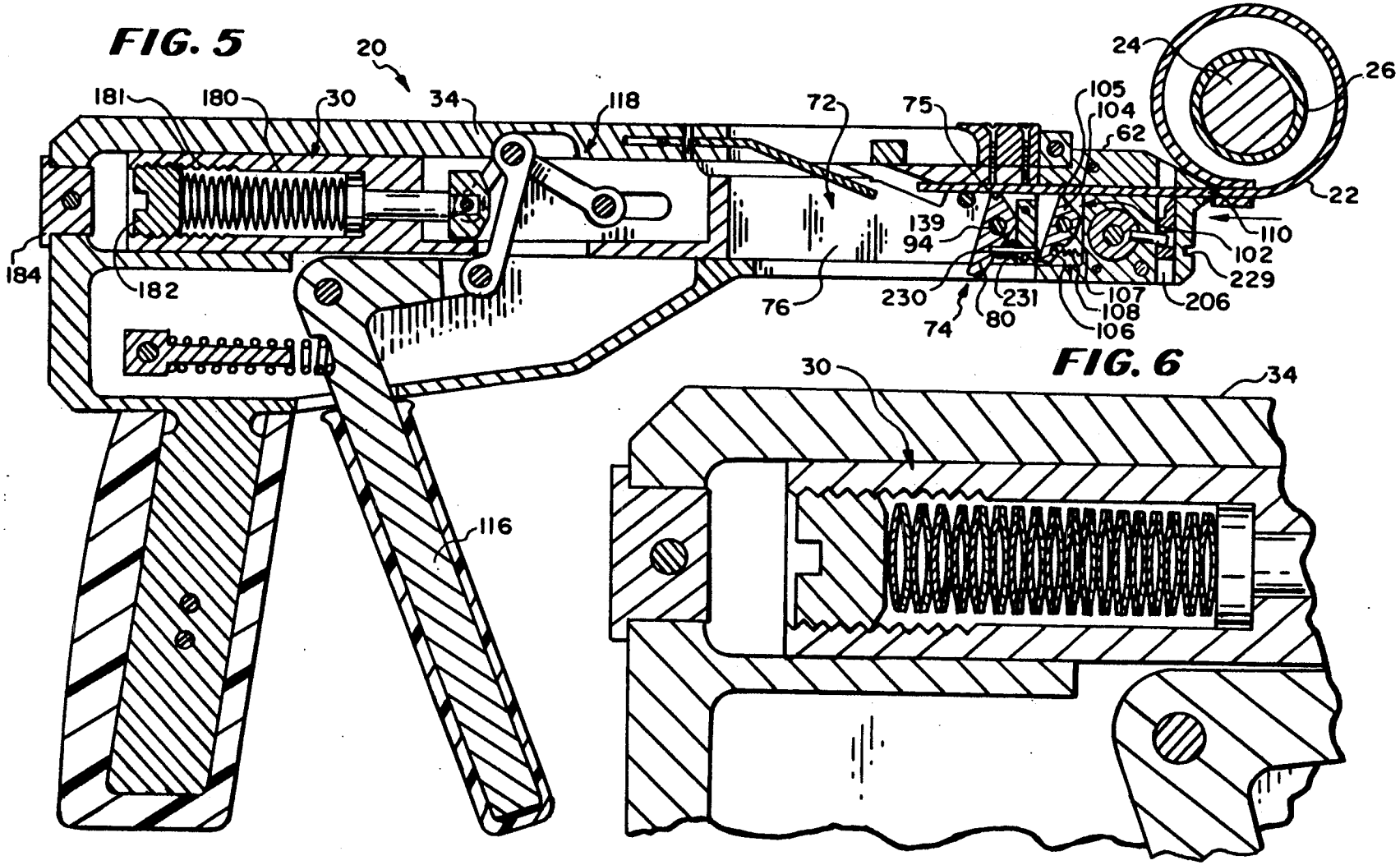
FIG. 5 is a sectional view of the manual banding tool illustrated in FIG. 1.
FIG. 6 is an enlarged partial sectional view of the rear portion of the banding tool illustrated in FIG. 1.

Once the band 22 is disposed in the feed track, the band 22 causes the retaining pawl 102 to be rotated in a counterclockwise direction (FIG. 5). During a return stroke of the shuttle assembly 72, the teeth 105 on the retaining pawl 104 hold the tension on the band 22.

The shuttle assembly 72 is mechanically connected to a pivotally mounted lever 116 by way of a overcenter toggle assembly 118. The overcenter toggle assembly 118 is also connected to a spring tensioning assembly 30. The spring tensioning assembly 30 prevents the shuttle assembly 72 from increasing the tension in the band 22, once the band tension limit is reached.

The toggle assembly 118 is disposed within a 119 slot on the top portion of the shuttle 76. The overcenter toggle assembly 118 includes a front pair of toggle links 124, a rear pair of toggle links 126 and a downwardly extending link 128. The front toggle links 124 are provided with apertures 130 for receiving a pin 132, which extends through a pair of slots 135 formed in opposing sidewalls 135 in the shuttle assembly 72 and inserted in apertures 233. During the forward and return stroke, the shuttle assembly 72 moves back and forth over a stationary pin 132.

The rear toggle links 126 are pivotally connected to the spring tensioning assembly 30. More particularly, a pivot block 136 is disposed adjacent the rear toggle links 126. An aperture 138, provided in the pivot block 136, is aligned with apertures 140 on the rear toggle links 134. A pin 143 is inserted through the apertures 138 and 140 to provide a pivotal connection between the rear toggle links 126 and the pivot block 136. An axial bore 150 in the pivot block 136 allows the shank portion 146 of spring actuator 148 to be inserted into the pivot block 136.

The toggle assembly 118 also includes a downwardly extending link 128. The link 128 is pivotally connected to the handle lever 116. The handle lever 116 is an L-shaped member formed on the top as a clevis 154. The downwardly extending link 128 is received between extending arm portions 156 of the clevis 154. A pin 158 is inserted through apertures 160 in the extending arm portions 156 and the aperture 162 in the downwardly extending link 152 to form a pivotal connection between the toggle assembly 118 and the handle lever 116. An aperture 164 is provided in the handle lever 116 for allowing the handle lever 116 to be pivotally mounted with respect to the right body half 32 and the left body half 34. A pin 165 is inserted through the aperture 164 in the handle lever 116. The ends of the pin 165 are supported by apertures 166 in the left body half 34 and the right body half 32.

The handle lever 116 is biased in a counterclockwise direction (FIG. 5) by a spring 170. The spring 170 is seated on a spring holder 172. The spring 170 and spring holder 172 is disposed between a bearing surface in the interior of the housing 31 (FIG. 5) and the handle lever 116. In the off the shelf position, the tensioning pawl assembly 74 is disposed adjacent the retaining pawl assembly 102. As the handle lever 116 is squeezed, the tensioning pawl assembly 74 moves in the direction of the arrow shown in FIG. 7. This causes the front toggle links 124 and the rear toggle links 126 to become relatively parallel with respect to each other, thus advancing the shuttle mechanism 72 rearwardly. Since the tensioning pawl assembly 74 is rigidly attached to the front portion of the shuttle assembly 72, this causes the band 22 to be advanced through the tool 20. Once the handle lever 116 is released, the spring member 170 causes the handle lever 116 to rotate in a counterclockwise direction, thus collapsing the toggle assembly 118 causing the shuttle assembly 72 to move forwardly in the direction shown by the arrow in FIG. 8.

In order to prevent overtensioning of a band 22, the spring tensioning assembly 30 is provided. The spring tensioning assembly is pivotally connected to the rear toggle links 126. During tightening of the band 22 at a tension well below the desired band tension limit, minimal force is applied to the spring tensioning assembly 30. However, once the tension in the band 22 exceeds the desired band tension limit, due to repeated squeezing and releasing of the handle lever 116, the force applied to the spring tensioning assembly 30 will be greatly increased. Since the front toggle links 124 and the rear toggle links 126 are relatively colinear during a forward stroke of the shuttle assembly 72, the force resulting from the gripping action will cause spring members 176 within the spring tensioning assembly 30 to collapse and prevent further movement of the shuttle assembly 72. Once the spring members 176 collapse, further squeezing of the handle lever 116 causes the front toggle links 124 and rear toggle links 126 to travel past their parallel overcenter position effectively locking the handle 116 in position at the calibrated tension setting.

The spring tensioning assembly 30 includes a plurality of spring members 176, such as Belleville spring washers and a spring actuator 148, pivotally connected to the toggle assembly 120 by way of the pivot block 136. The spring actuator 148 is formed with a head portion 178 on one end, which provides a bearing surface for the spring members 176. The spring members 176 are received in a circular bore 180, formed in the shuttle assembly 72.

An important aspect of the invention relates to the ability to adjust the spring tension at which the spring members 176 collapse. This is provided by an adjustment screw 182, which provides a bearing surface for the other end of the spring members 176. The adjustment screw 182 is received in a threaded portion 181 of the circular bore 180 in the shuttle assembly 72. By providing an adjustment screw 182, the spring tension at which the spring members 176 collapse can be adjusted rather easily by either advancing or withdrawing the adjustment screw 182 in the threaded bore portion 181, even while the tool 20 is coupled to a test device.

An adjustment screw cover 184 is provided, which fits over the adjustment screw 182. The cover 184 fits in an aperture 186, formed by the right body half 32 and the left body half 34. A transverse aperture 188 is provided in the spring cover 184. Once the spring cover 184 is inserted into the aperture 186 and aligned with an aperture 189 in the housing 31, a fastener 190 may be used to secure the spring cover to the right body half 32 and the left body half 34.

Figures 11, 12:
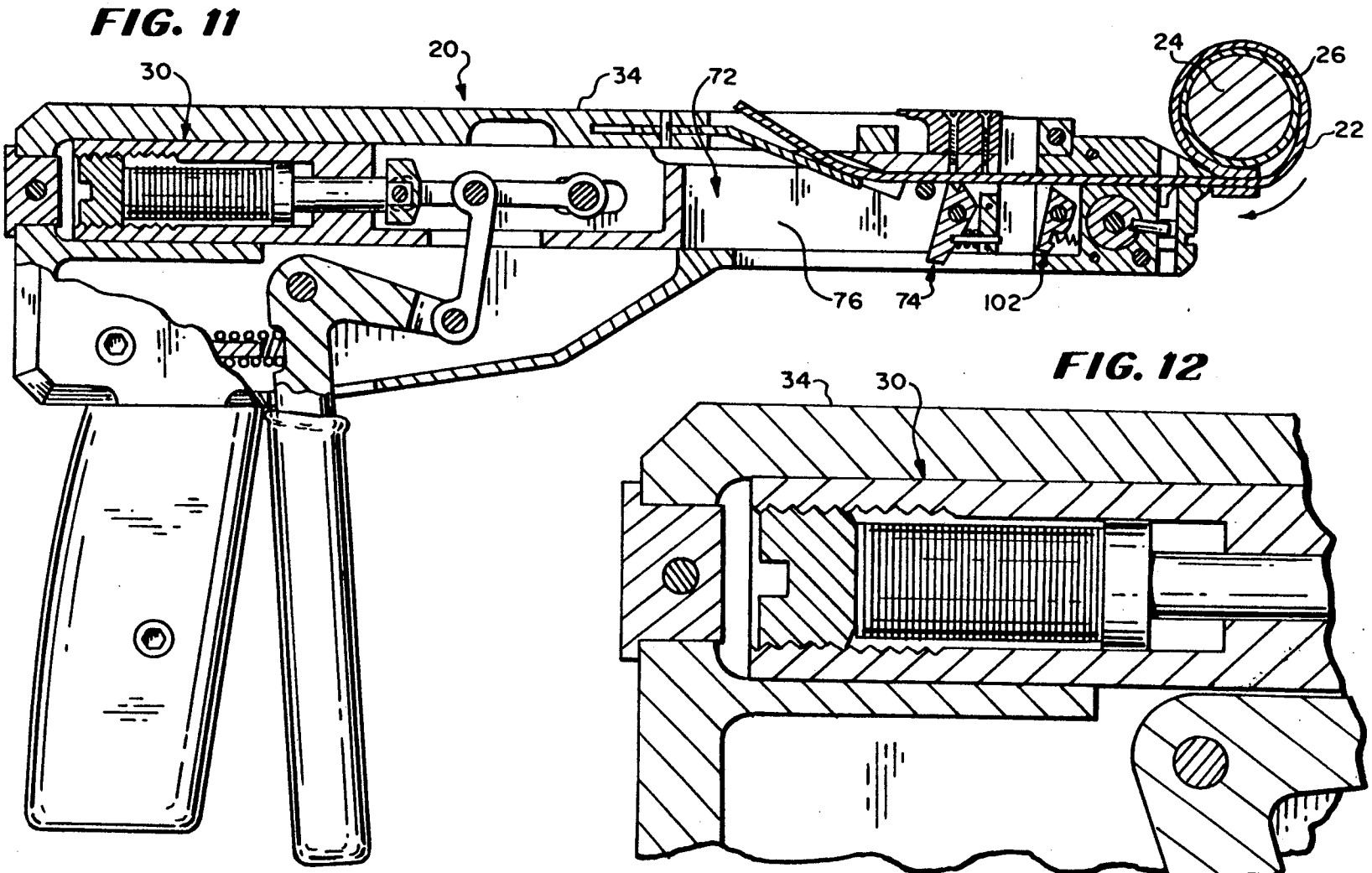
FIG. 11 is a sectional view of the tool illustrated in FIG. 1, showing the position of the components when the band tension limit is reached.
FIG. 12 is a partial view of the rear portion of the tool in accordance with the present invention illustrating the spring tensioning device after the band tension limit is reached.
Figure 13:
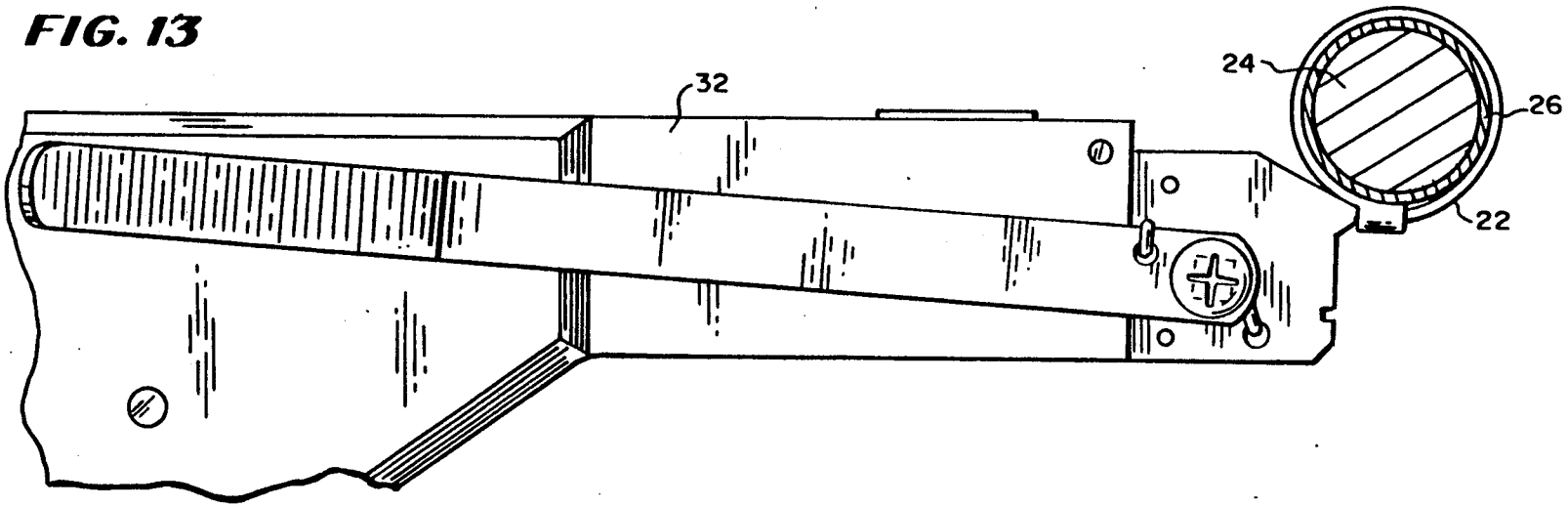
FIG. 13 is a partial elevational view of the front portion of the tool illustrating a band tightened about a termination sleeve of an electrical connector.

As shown in FIG. 6, the spring members 176 are formed from a plurality, for example, thirty-six (36) Belleville washers, stacked in pairs with the cupped portions facing each other, as illustrated in FIG. 6. When a force greater than the spring force of the washers is applied, the washers flatten out as illustrated in FIG. 12. Once the force is removed the washers spring back to their original cupped shape. Although Belleville washers are shown and described, it should be understood by ordinary skill in the art that other types of spring members may also be used and be within the broad scope of the present invention.

Figure 14:
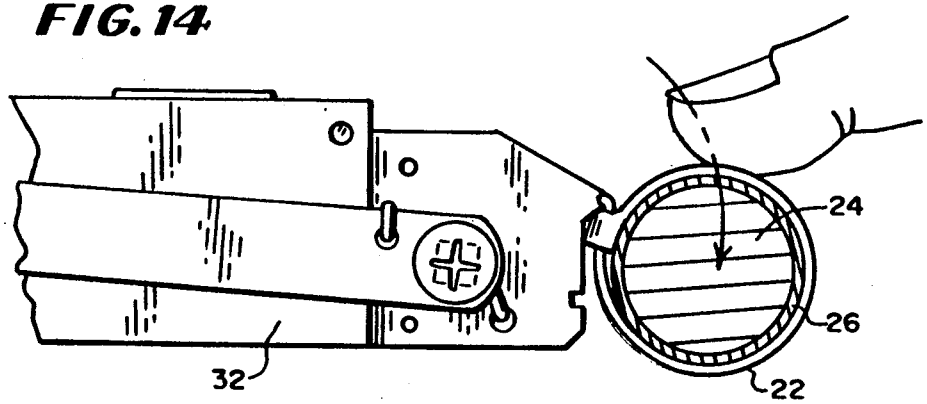
FIG. 14 is a partial elevational view of the front portion of the tool illustrating the operation of bending the band at approximately a 90° angle with respect to the buckle.

Another important aspect of the invention relates to the means for rolling an extending tail portion 192 of the band 22 over the buckle 194. More specifically, once the desired band tension is attained, the termination is manually rotated with respect to the nosepiece assembly 62. This may be done by placing a finger on the top portion of the termination and pushing it in the direction shown by the arrow in FIG. 14. This causes the extending tail portion 192 to be bent at roughly a 90° angle with respect to the buckle 194. This will maintain the tension in the band such that the band can be sheared and the termination removed from the tool.

Figure 15:
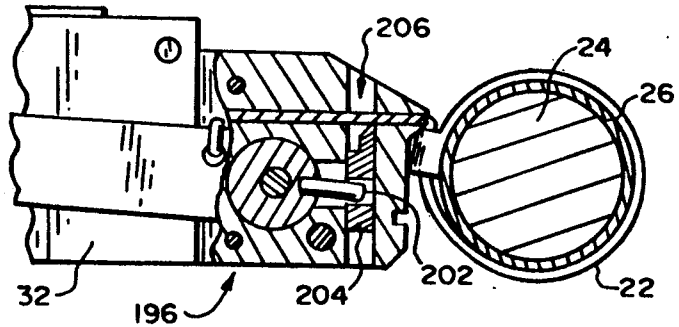
FIG. 15 is a partial sectional view of the tool in accordance with the present invention showing the cutter mechanism before the band is sheared.
Figure 16:
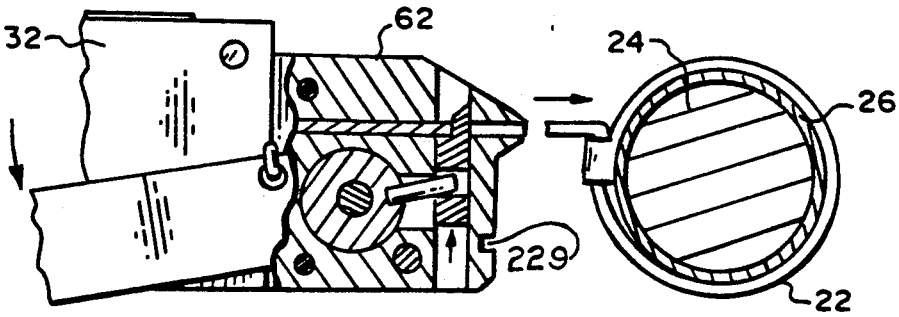
FIG. 16 is a partial sectional view of the front portion of the tool illustrating the cutter mechanism after the band has been sheared.

As shown in FIG. 15, the feed track for the band 22 extends adjacent a cutting assembly 196, formed adjacent the feedtrack. The cutting assembly 196 is formed as a part of the nosepiece assembly 62 and includes a cutter shaft 198 having a radially extending protuberance 200, a cutter 204 and a cutter lever 212. The radially extending protuberance 200 extends within an aperture 202 formed in the cutter 204. The cutter 204 is disposed in a transverse bore 206 in the nosepiece assembly 62 to mechanically couple the cutter shaft to the cutter 204.

The cutter shaft 198 is generally a circular cylindrical member having a square end 208. The square end 208 is adapted to be received in a square hole 210 provided in one end of the cutter lever 212. In order to secure the cutter lever 212 to the cutter shaft 198, a fastener 214 is inserted into a threaded bore 216 in the square end 208 of the cutter shaft 198. A torsion spring 218 is provided to bias the cutter lever 212 in a relatively horizontal position. The torsion spring 218 is attached between an aperture 220 in the cutter lever 212 and an aperture 222 in the right body half 32. In operation when the cutter lever 212 is moved downwardly, the cutter 204 is moved upwardly in the transverse bore 206, thereby shearing the band 22 to allow it to be removed from the tool.

Figure 17:
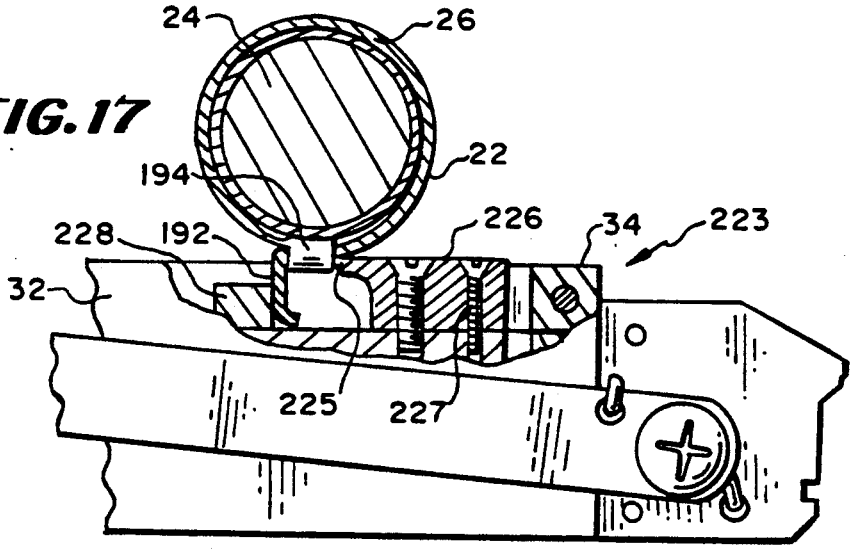
FIG. 17 is a partial sectional view of the front portion of the banding tool in accordance with the present invention illustrating the rollover mechanism in its initial state.
Figure 18:
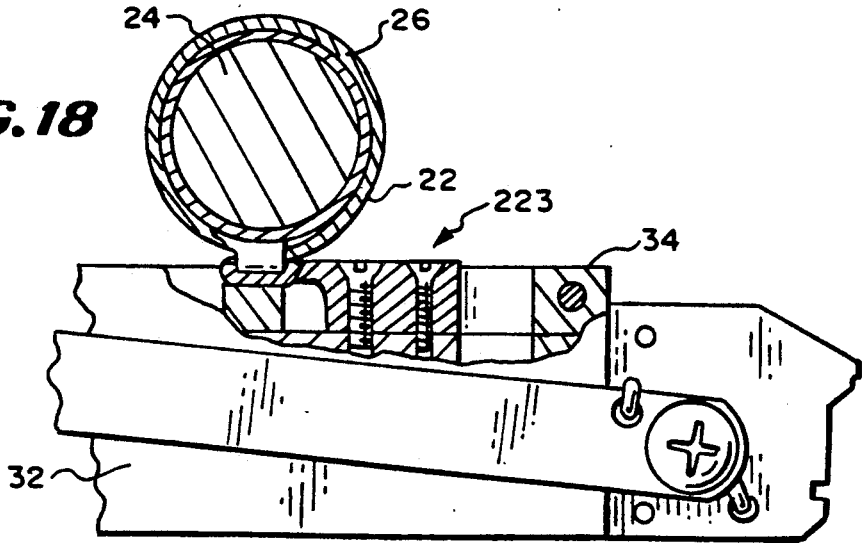
FIG. 18 is similar to FIG. 17 and illustrates the rollover mechanism after the tail portion of the band has been rolled completely over the buckle.

Another important aspect of the invention relates to a rollover assembly 223, shown best in FIGS. 17 and 18. Once the completed termination is removed from the tool, the tail portion 192 of the band 22 is at approximately a 90° angle with respect to the buckle 194 to maintain the tension in the band 22. The end of the band 22 is then inserted in a slot 229 formed on a front surface of the nosepiece assembly 62 to prebend the end of the band 22 forming a rounded end on the tab to create a burr free termination. The termination is placed in a rollover assembly 223 located at the top portion of the tool as shown in FIG. 17, such that an extending lip portion 225 of a rollover member 226 is disposed against the edge of the buckle 194, opposite the end with the extending tail 192.

The rollover assembly 223 is attached to the shuttle assembly 72 with a pair of fasteners 227, thus allowing the rollover assembly 223 to be actuated by the handle lever 116. When the termination is properly inserted into the rollover assembly 223, the tail portion 192 will engage the rollover block 228, disposed adjacent the rollover assembly 223. Once the handle lever 116 is squeezed, the shuttle assembly 72 will move rearwardly causing the extending tail 192 to be bent back over the buckle 194 as shown in FIG. 18 and cause the prebent tab to point downwardly toward the band to hide sharp edges. The completed termination may then be removed from the tool. Accordingly, it should be clear that a single tool has been described which can tighten a band 22 about a termination sleeve 24, shear the band to allow the termination to be removed from the tool 20 and also bend the extending tail 192 over the buckle 194 to form a completed termination.

It should be understood that although particular embodiments of the invention have been shown and illustrated, it is to be understood that the present invention is not intended to be so limited. As will be appreciated by those of ordinary skill in the art, the spirit and scope of the appended claims are intended to cover various embodiments, all considered to be within the broad scope of the invention, such as the use of a helical spring for the spring member 176.

What is claimed and desired to be secured by Letters Patent is:

1. A banding tool for tightening a band about a tubular member within predetermined tension limits comprising:

shuttle means, reciprocally mounted within the tool, for incrementally advancing the band through the tool during a drive strike, said drive stroke having a predetermined length;

lever means, operatively connected to said shuttle means, for moving said shuttle means during said drive stroke;

tension setting means, operatively coupled to said shuttle means, for preventing the shuttle means from advancing the band through the tool when the tension in the band is greater than a predetermined value;

tension retention means for retaining the tension in said band during a return stroke of said shuttle means; and adjustment means defining a predetermined adjustment range, operatively coupled to said tension setting means, or allowing continuous adjustment of the tension in said tension setting means over a substantial portion of the adjustment range while substantially maintaining said predetermined length of said drive stroke; and cutter means which includes a cutter for cutting said band; wherein said band includes a buckle which defines a tail portion extending outwardly from said buckle after said band has been cut by said cutter; and rollover means for rolling said tail portion over said buckle.

2. A banding tool as recited in claim 1, wherein said rollover means is operatively coupled to said advancing means.

3. A banding tool as recited in claim 1, wherein said rollover means is disposed adjacent the top portion of the tool.

4. A banding tool for tightening a band about a tubular member within predetermined tension limits comprising:

shuttle means, reciprocally mounted within the tool, for incrementally advancing the band through the tool during a drive stroke, said drive stroke having a predetermined length;

lever means, operatively connected to said shuttle means, for moving said shuttle means during said drive stroke;

tension setting means, operatively coupled to said shuttle means, for preventing the shuttle means form advancing the band through the tool when the tension in the band is greater than a predetermined value;

tension retention means for retaining the tension in said band during a return stroke of said shuttle means;

adjustment means, operatively coupled to said tension setting means, or adjusting the tension in said tension setting means while substantially maintaining said predetermined length of said drive stroke;

cuter means which includes a cutter for cutting said band, wherein said band includes a buckle which defines a tail portion extending outwardly from said buckle after said band has been cut by said cutter;

rollover means for roling said tail portion over said buckle; and means for prebending the end of the band toward the band surface after said band has been cut prior to rolling said tail portion over said buckle.

* * * * *